US011684534B2

(12) United States Patent
Erickson et al.

(10) Patent No.: US 11,684,534 B2
(45) Date of Patent: Jun. 27, 2023

(54) CHIROPRACTIC ADJUSTMENT AND SOFT TISSUE MOBILIZATION TOOL

(71) Applicants: Nicholas Hans Erickson, Boone, IA (US); Jeffery Sam Redenius, Lake City, IA (US)

(72) Inventors: Nicholas Hans Erickson, Boone, IA (US); Jeffery Sam Redenius, Lake City, IA (US)

( * ) Notice: Subject to any disclaimer, the term of this patent is extended or adjusted under 35 U.S.C. 154(b) by 364 days.

(21) Appl. No.: 16/952,034

(22) Filed: Nov. 18, 2020

(65) Prior Publication Data

US 2021/0069048 A1 Mar. 11, 2021

Related U.S. Application Data

(60) Provisional application No. 62/937,747, filed on Nov. 19, 2019.

(51) Int. Cl.
*A61H 1/00* (2006.01)

(52) U.S. Cl.
CPC ..... *A61H 1/008* (2013.01); *A61H 2201/0153* (2013.01); *A61H 2201/105* (2013.01); *A61H 2201/1253* (2013.01); *A61H 2201/1695* (2013.01); *A61H 2205/04* (2013.01); *A61H 2205/081* (2013.01)

(58) Field of Classification Search
CPC ..... A61H 1/008; A61H 2201/0153; A61H 2201/105; A61H 2205/04; A61H 2205/081; A61H 2201/1609; A61H 2201/1623; A61H 2201/169; A61H 1/0292
See application file for complete search history.

(56) References Cited

U.S. PATENT DOCUMENTS

2007/0276438 A1* 11/2007 Meglin ..... A61H 1/0292 606/237
2008/0312690 A1* 12/2008 Tsai ..... A61H 1/008 606/237
2016/0000637 A1* 1/2016 Shakarian ..... A61H 1/008 601/138
2016/0338901 A1* 11/2016 Cohen ..... A61H 15/00
2016/0361221 A1* 12/2016 Ebbers ..... A61H 1/008

* cited by examiner

*Primary Examiner* — Philip R Wiest
*Assistant Examiner* — Sarah B Lederer
(74) *Attorney, Agent, or Firm* — Brett A. Schenck

(57) ABSTRACT

Presented is a chiropractic adjustment and soft tissue mobilization tool. The tool includes a flat bottom section, and a spine adjustment section. The spine adjustment section includes two raised supports aligned substantially parallel, and a spine accommodating area formed along and between the length of the two raised supports for supporting an intended vertebrae portion of a patient's spine during chiropractic adjustment. The spine adjustment section further transitions to form a protruding edge adapted for performing soft tissue mobilization. The protruding edge further protrudes upwardly and rolls off to form a planar raised surface parallel to the flat bottom. Each side of the spine adjustment section features a recessed area formed thereof to allow a provider to hold the tool with the provider's fingertips and to aid in collection and re-dispersal of lotion applied during soft tissue mobilization procedure.

17 Claims, 14 Drawing Sheets

CHIROPRACTIC ADJUSTMENT AND SOFT TISSUE MOBILIZATION TOOL

CROSS-REFERENCE TO RELATED PATENT DOCUMENTS

This patent application claims the benefit of priority of U.S. Provisional Application No. 62/937,747 entitled "Chiropractic Adjustment and Manipulation Tool" filed on Nov. 19, 2019, which is hereby incorporated herein by reference in its entirety.

FIELD OF THE INVENTION

The invention relates to devices for use in performing chiropractic treatments. More specifically, the present invention relates to a multi-purpose hand held tool to aid a chiropractor or physical therapist during spinal manipulations and for performing soft tissue mobilization (STM) and instrument assisted soft tissue mobilization (IASTM) procedures.

BACKGROUND

Chiropractic and physical therapy treatments are concerned with adjusting misaligned body structures by manually manipulating the various joints in the human body in general and more specifically, manipulating a human spine comprised of interconnected vertebrae. Unlike other body parts or structures, the spinal column must be treated or manipulated with extreme caution because of its link with the central nervous system.

The spinal column may be susceptible to misalignment, trauma and pain, and degeneration as a result of age, abuse, or disease. Chiropractors and physical therapists, known as providers, use their hands and/or adjustment devices to successfully treat abnormalities of the spinal column to relieve any pain or discomfort that the patient might be suffering. Commonly, while performing spinal column adjustments, chiropractors and physical therapists may apply thrusts or forces to the afflicted region of the spine to mobilize or manipulate the spine. The chiropractor or physical therapist may need to perform dozens of spinal manipulations in a given day and when these manipulations are done using the hands alone (as a primary means of adjusting), the provider's hand can be exposed to significant stress and strain that can lead to aches and pains in the provider's hand and fingers.

Generally speaking, there are a number of solutions available for spinal adjustments. Some of these solutions provide one or more raised surfaces to exert additional force on the area of the spine being treated, but fails to protect the chiropractor's hand sufficiently during the spine manipulation. Further, some of the solutions are designed to provide ample protection to the chiropractor's hand but it is hard to determine the proper placement location on the spine using such solutions since the chiropractor's hand gets fully encased in the tool. In addition, most of the available solutions for spine adjustments are explicitly designed for chiropractic adjustment and cannot be used for other adjustment and manipulation procedures such as soft tissue mobilization and instrument assisted soft tissue mobilization (IASTM).

Broadly speaking, one such solution is available in the form of tables, also known as "adjusting tables". When combined with the knowledge, skill, and experience of the chiropractor, such tables are used in therapeutic chiropractic manipulation as a means of restoring and enhancing the well-being of the patient. Using such adjusting tables, chiropractors are able to manage the biomechanical relationship of the patient's spinal segments in relationship to each other as part of the overall central nervous system. Chiropractic tables of the prior art lack certain functionalities that could assist the chiropractor in the application of his or her treatment of the patient. For example, while such tables may include drop sections for assisting the chiropractor during application of the above-mentioned manipulative spinal treatments, however, they are very limited in their use, due to the soft platform of the table thereby making is difficult to pinpoint the treatment area. In addition, these adjusting tables are quite complex and expensive as well.

Another kind of solution is available in the form of a hand operated chiropractic device. For example, U.S. Pat. No. 1,640,536 discloses a hand held massaging device comprising a handle for a carrying the ends thereof the frame pieces which are held together by the rivet and formed in the lower portion of the device to provide the legs, the legs are connected with the side straps. Further, the patent mentions that the lower portions of the legs are in yieldable relation to each other and are maintained at fixed distances apart by suitable adjusting screws. The device further includes pads, a bridge connecting the covers, means in the bridge whereby relative adjustment of the pads is obtained and a spring supported plunger associated with the bridge through which a blow directed to the device will be yieldably transmitted to the pads. While this device may provide an alternative to adjusting and messaging a patient's spine, it requires a blow from the provider's hand to operate the device. This blow required to operate the device does not adequately protect the provider's hand and joints, especially given that the provider would need to repeat the blow numerous times and on several patient's in a given day.

U.S. Pat. No. 3,901,222A discloses a chiropractic adjusting device capable of easily adjusting the position of the pressing member in accordance with a patient's body structure. The chiropractic adjusting device comprises an elongate bedplate and a pair of pressing members retained on said bedplate with the pressing planes thereof opposed to each other and adopted to render the interval between said pressing planes adjustable. While this device may aid in adjusting a patient's spine, it does not provide a hand held device that can be easily transported and located at the precise treatment area of the patient's back. Furthermore, it serves no functionality for soft tissue mobilization treatments.

U.S. Pat. No. 4,230,099 discloses a device for use in aligning a human spine. More specifically, the device as disclosed in the patent is positioned beneath the back of a human lying supine on a supporting surface such as a floor or the like to align the human's spine.

US20070276438A1 discloses a massager device that includes two or more rollers, attached by arms to a central spring. The spring biases the arms carrying the rollers together, so that a force applied between the rollers is required to separate them. Each of the rollers can include multiple segments, all of which are carried on common, optionally flexible, axles attached to the arms. The paraspinous muscles lie in the space between the transverse processes and the spinous process. These muscles extend vertically along the length of the spine. When a person leans the affected portion of their spine against the rollers of the device, the shape of the spine presses the rollers apart causing them to massage the paraspinous muscles perpendicular to their long axis by flattening them against the ribs and transverse processes. The paraspinous muscles are pushed laterally away from the midline, perpendicular to their long axis.

Although, the aforementioned and many other chiropractic devices/instruments are proposed in the past, there still remains a need for an improved chiropractic tool that facilitates chiropractic manipulation while relieving any unnecessary stress on the chiropractor's hands and also can also help in performing soft tissue mobilization and instrument assisted soft tissue mobilization (IASTM) procedures

BRIEF SUMMARY

An object of this invention is to provide a multipurpose tool specifically designed for use by chiropractors and/or physical therapists. The tool is designed to protect the hands of the chiropractors and/or physical therapists while they manipulate the spine of their patients as a course of treatment.

Another object of this invention is to provide a chiropractic adjustment and manipulation tool that mimics the hands of the chiropractor and is helpful in adjusting spine of a patient and is capable of taking the force off the shoulder and hand of the chiropractor.

Another object of this invention is to provide a chiropractic adjustment and manipulation tool that is designed to give a comfortable adjustment to patients.

Another object of the present invention is to provide multipurpose tool that's not only useful in adjusting spine of a patient but can also be used to perform other treatments, such as soft tissue mobilization (STM) or instrument assisted soft tissue mobilization (IASTM) procedures. Additionally, the tool is designed in a way that helps conserve lotion when applied during soft tissue mobilization procedure and re-disperse when necessary.

Another object of the present invention is to provide a tool designed to protect the chiropractor's hand during treatment, but also allow the chiropractor to feel and locate the patient's spine or treatment area with their thumb and fingers while holding and using the tool.

Further object of the present invention is to provide a tool that would comfortably fit a wide array of chiropractor's hand sizes.

An embodiment of the present invention disclosed is a chiropractic adjustment and soft tissue mobilization tool. The tool includes a flat bottom section, a spine adjustment section having a first raised support, and a second raised support substantially parallel to and aligned with one another at a substantially constant distance apart from one another, and a spine accommodating area concavely formed along and between the length of the first raised support, and the second raised support, whereas the spine accommodating area is adapted for supporting an intended vertebrae portion of a patient's spine during chiropractic adjustment.

According to an embodiment, each end of the spine adjustment section further transitions to form a protruding edge, adapted for performing soft tissue mobilization procedures, and wherein, each of the protruding edges of the spine adjustment section further protrudes upwardly and rolls off to form a planar raised surface parallel to the flat bottom. The planar raised surfaces together with the flat bottom section serves to function as an open pocket facilitating the provider to slide the fingers therein for holding the tool. The open pocket is substantially "C" shaped and serves as a handgrip for the tool. According to an embodiment, at least one of the planar raised surfaces selectively embodies at least one magnet to allow the provider to attach the tool to a surface for storage in an easy-to-access location.

According to an embodiment, each side of the spine adjustment section features a recessed area formed thereof to allow a provider to hold the tool with the provider's fingertips, and to aid in collection and re-dispersal of lotion applied during soft tissue mobilization procedure. According to an embodiment, each of the recessed areas further includes at least one thumb depression to allow the provider to hold the tool with either hand. The thumb depression(s) is located either at one end or both the ends of each of the recessed areas.

According to an exemplary embodiment, the tool may further include a secondary surface attached over the first raised support and second raised support to create a softer surface of the first raised support and second raised support. The secondary surface may be comprised of a gel coat surface, rubber surface, or a urethane surface.

According to an embodiment, the tool is a unitary tool made from a material consisting of wood, plastic or composite material.

These and other features, advantages and objectives of the invention will become apparent from the detailed description below, in light of the accompanying drawings.

BRIEF DESCRIPTION OF THE ACCOMPANYING DRAWINGS

In the accompanying drawings.

DETAILED DESCRIPTION

As used in the specification and claims, the singular forms "a", "an" and "the" include plural references unless the context clearly dictates otherwise. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. Those with ordinary skill in the art will appreciate that the elements in the figures are illustrated for simplicity and clarity and are not necessarily drawn to scale. For example, the dimensions of some of the elements in the figures may be exaggerated, relative to other elements, in order to improve the understanding of the present invention. References to "one embodiment", "an embodiment", "another embodiment", "an example", "another example", and so on, indicate that the embodiment(s) or example(s) so described may include a particular feature, structure, characteristic, property, element, or limitation, but that not every embodiment or example necessarily includes that particular feature, structure, characteristic, property, element or limitation.

Before describing the present invention in detail, it should be observed that the present invention constitutes a chiropractic adjustment and soft tissue mobilization tool that may be a single piece unit or multi pieces unit. Accordingly, the components or parts, their interconnectivity and operation have been represented, showing only specific details that are pertinent for an understanding of the present invention so as not to obscure the disclosure with details that will be readily apparent to those with ordinary skill in the art having the benefit of the description herein.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1A:
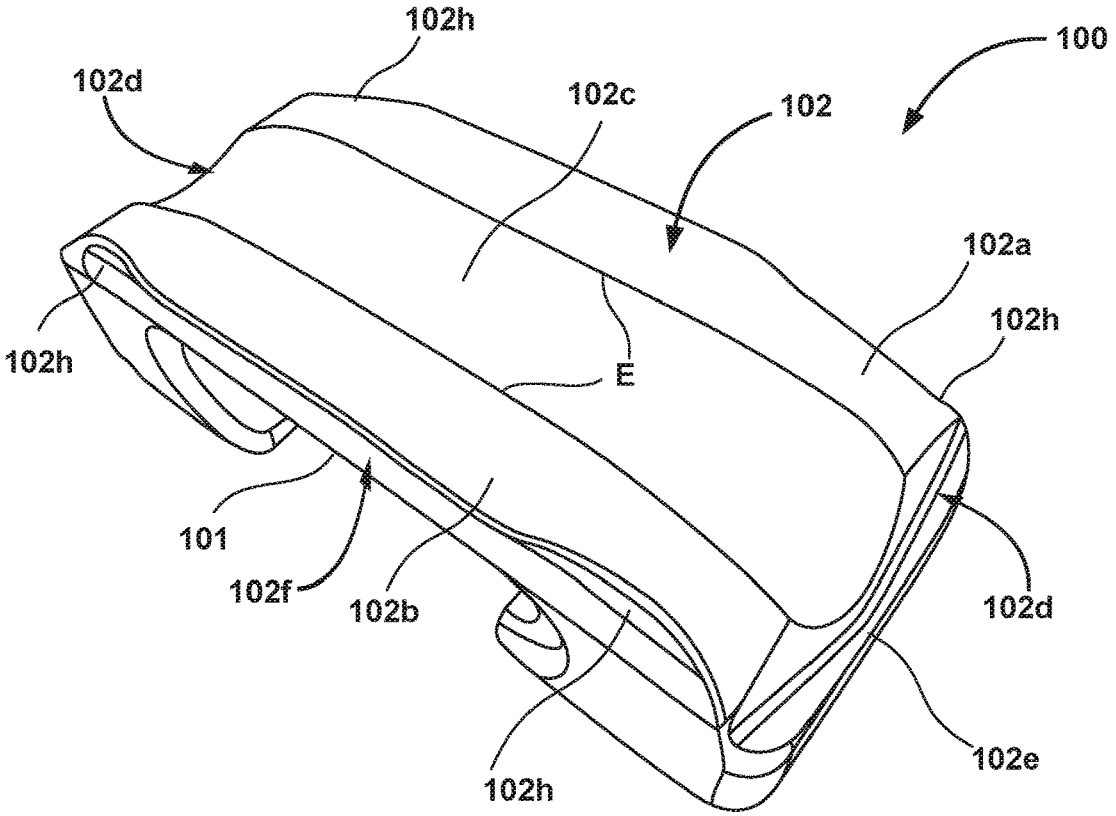
FIGS. 1A-1B show top perspective views of a chiropractic adjustment and soft tissue mobilization tool, according to an embodiment of the present invention.
Figure 1B:
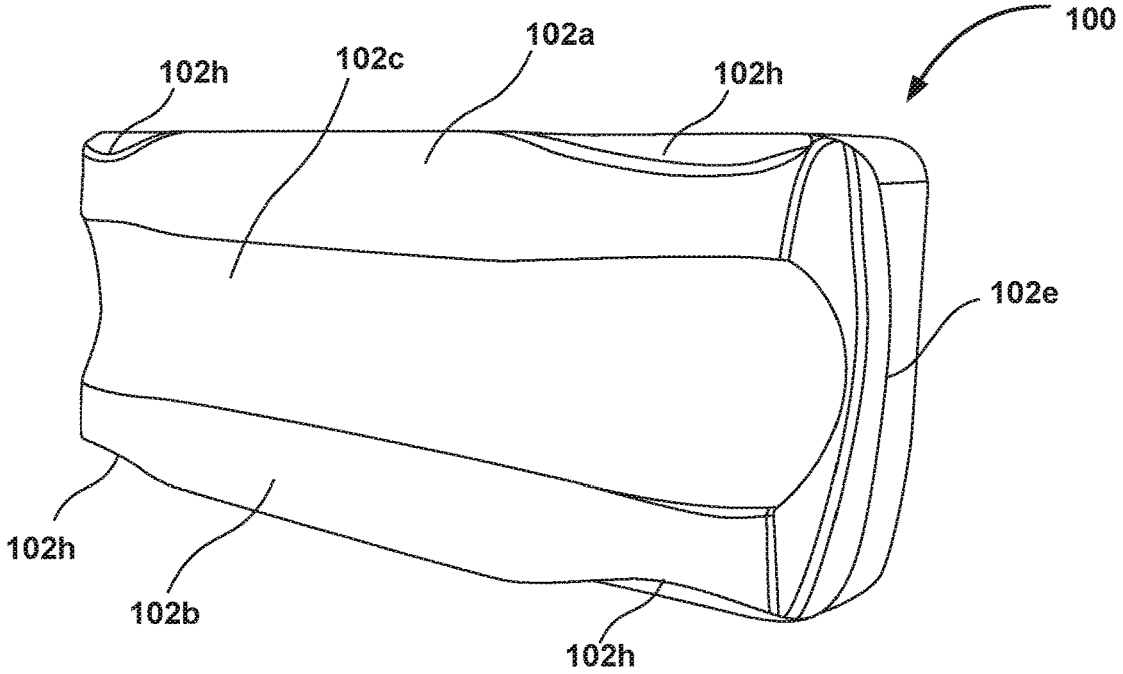

The multi-purpose hand held tool of the present invention, and various embodiments thereof will now be discussed in detail with respect to the accompanying drawings FIGS. 1-21. With reference to the drawings and in particular to FIGS. 1A-1B, 2A-2B, 3-4, and 5A-5B thereof, the chiropractic adjustment and soft tissue mobilization tool 100 according to the present invention mainly includes a flat bottom section 101, and a spine adjustment section 102. The spine adjustment section 102 comprises a first raised support 102*a*, and a second raised support 102*b* substantially parallel to one another and aligned with one another at a substantially constant distance. The area between the raised support 102*a*, and the raised support 102*b* acts as a spine accommodating area 102*c*. The spine accommodating area 102*c* is concavely curved (with a central depth of 'd') that extends between the edges "E" of the raised supports 102*a*, and 102*b* (as seen in FIGS. 1A and 3). This spine accommodating area 102*c* is adapted for supporting an intended vertebrae portion of a patient's spine during chiropractic adjustment as will be explained in detail in the description to follow.

According to the embodiment, the spine adjustment section 102 comprises two opposing ends 102*d*. Each end 102*d* of the spine adjustment section 102 extends and transitions to form a protruding edge 102*e* at each end of the spine adjustment section 102. These edges 102*e* located at two opposing ends of the spine adjustment section 102 is adapted for performing soft tissue mobilization procedure as will be described in the description to follow. In an example, the edges 102*e* may include rounded corners. In another embodiment the corners may not be rounded.

Figure 2A:
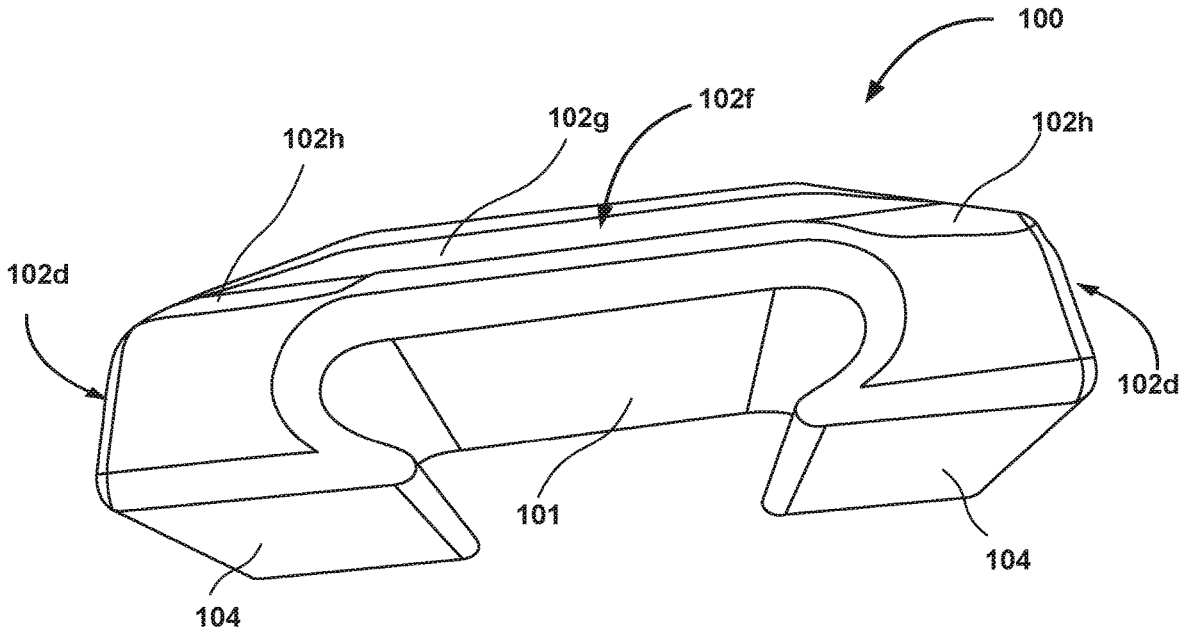
FIGS. 2A-2B show side perspective views of the chiropractic adjustment and soft tissue mobilization tool of FIGS. 1A-1B.
Figure 2B:
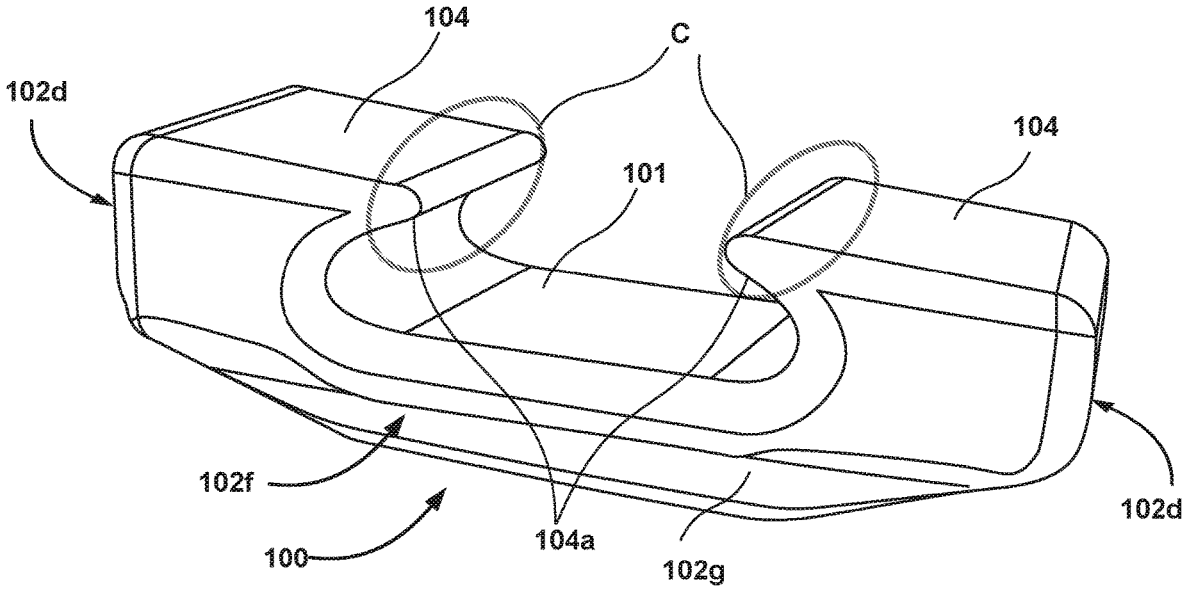
Figure 3:
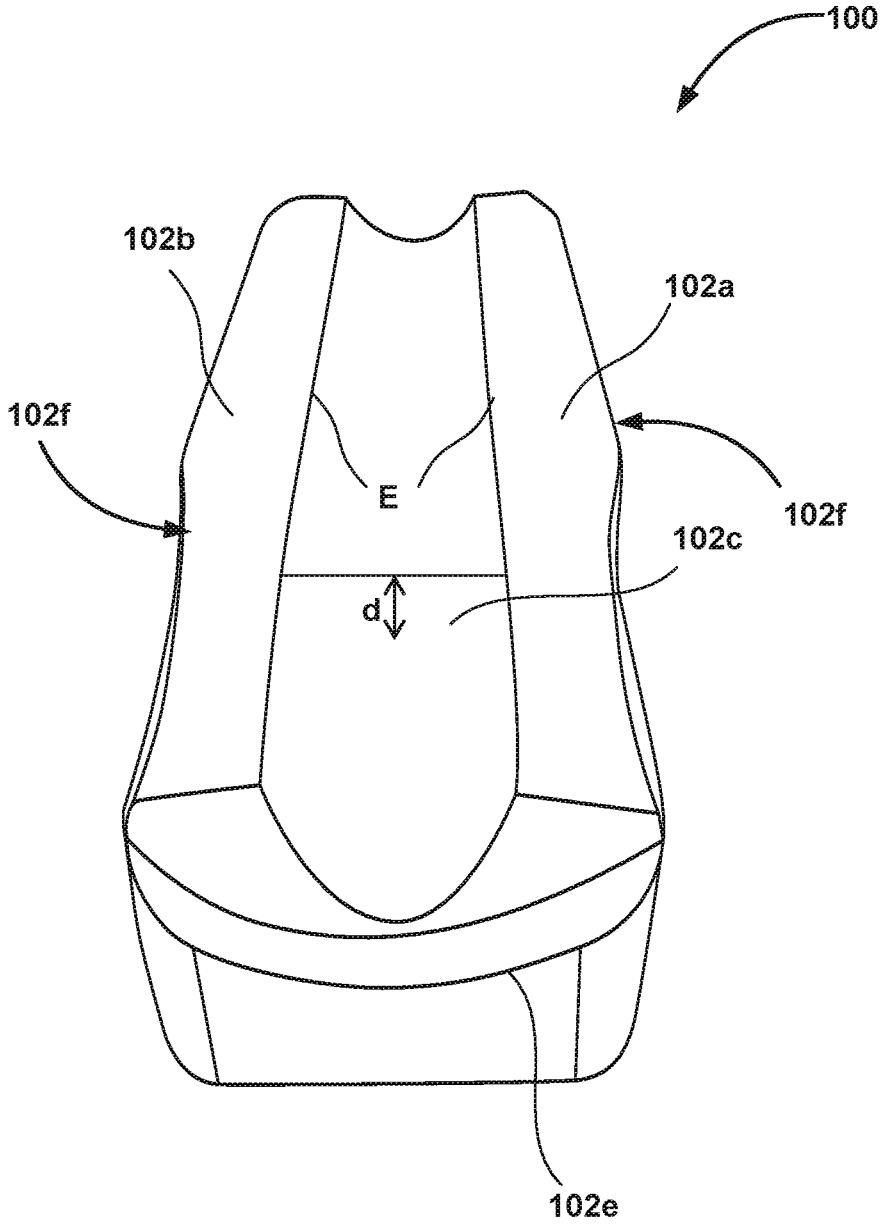
FIG. 3 shows an isometric end view of the chiropractic adjustment and soft tissue mobilization tool of FIGS. 1A-1B.
Figure 4:
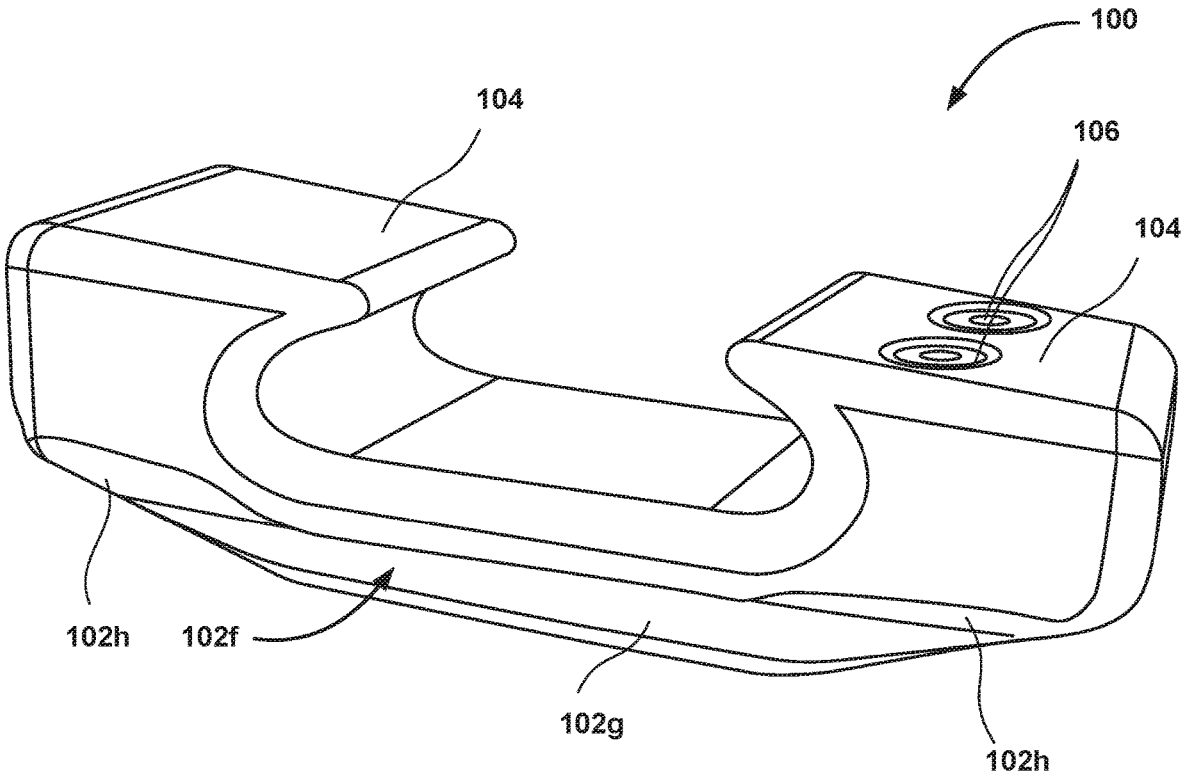
FIG. 4 shows a side perspective view of the chiropractic adjustment and soft tissue mobilization tool, according to another embodiment of the present invention.

According to the embodiment, each of the edges 102*e* of the spine adjustment section 102 further protrudes upwardly and rolls off or curves to form a planar raised surface 104 aligned parallel to the flat bottom 101 as a cut out section represented as 'C' (seen in FIG. 2B). These cut out sections 'C' at two ends serves to help a provider to cradle the tool 100 using fingers. The raised surfaces 104 together with the bottom section 101 serves to function as an open pocket. The open pocket facilitates a provider (e.g. physical therapist or chiropractor) to slide his/her fingers therein for holding the tool 100 in many different ways. The open pocket is substantially "C" shaped and serves as a handgrip area for the tool 100. The raised surfaces 104 also serve to increase the contactable surface area against the adjustment table or wall, wherein each surface 104 acts as a contact bridge across the back of the provider's hand so as to relieve the force that would otherwise be applied to the provider's hand. According to an embodiment, one or both of the planar raised surfaces 104 may embody at least one magnet 106 (as seen in FIG. 4) to allow the provider to attach the tool 100 to a surface for storage in an easy-to-access location.

According to the embodiment, the tool includes two opposite sides 102*f*. Each side of the spine adjustment section 102 features a recessed or depression area 102*g* that runs along the length of the tool 100 to allow the provider to hold the tool 100 with the provider's fingertips. The recessed or depression area 102*g* may run through entire length or partial length of the spine adjustment section 102. The recessed area 102*g* also aid in collection and redispersal of lotion applied during soft tissue mobilization procedures.

According to the embodiment, the recessed areas 102*g* may further include at least one thumb depression 102*h* to allow the provider to hold the tool 100 with either hand. The thumb depression 102*h* is located either at one end or both the ends of each of the recessed areas 102*g*. In an example, there may be four thumb depressions 102*h* in the tool 100, particularly, a thumb depression 102*h* located at each end of each of the recessed areas 102*g*. In some embodiment, either one or two thumb depressions 102*h* may be present at just one recessed area 102*g* at one side of the tool 100. In some other embodiment, just one thumb depression may be present at just one end of the recessed areas 102*g* on two sides of the tool 100.

Figure 5A:
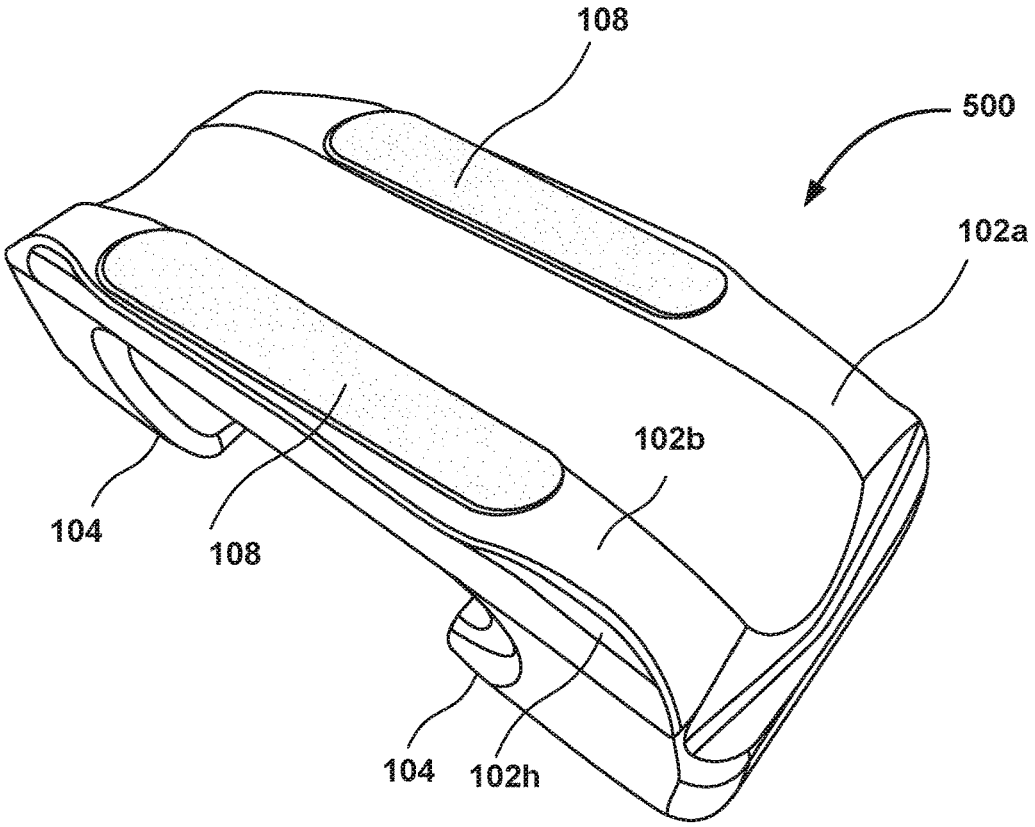
FIGS. 5A-5B show top perspective views of the chiropractic adjustment and soft tissue mobilization tool, according to another embodiment of the present invention.
Figure 5B:
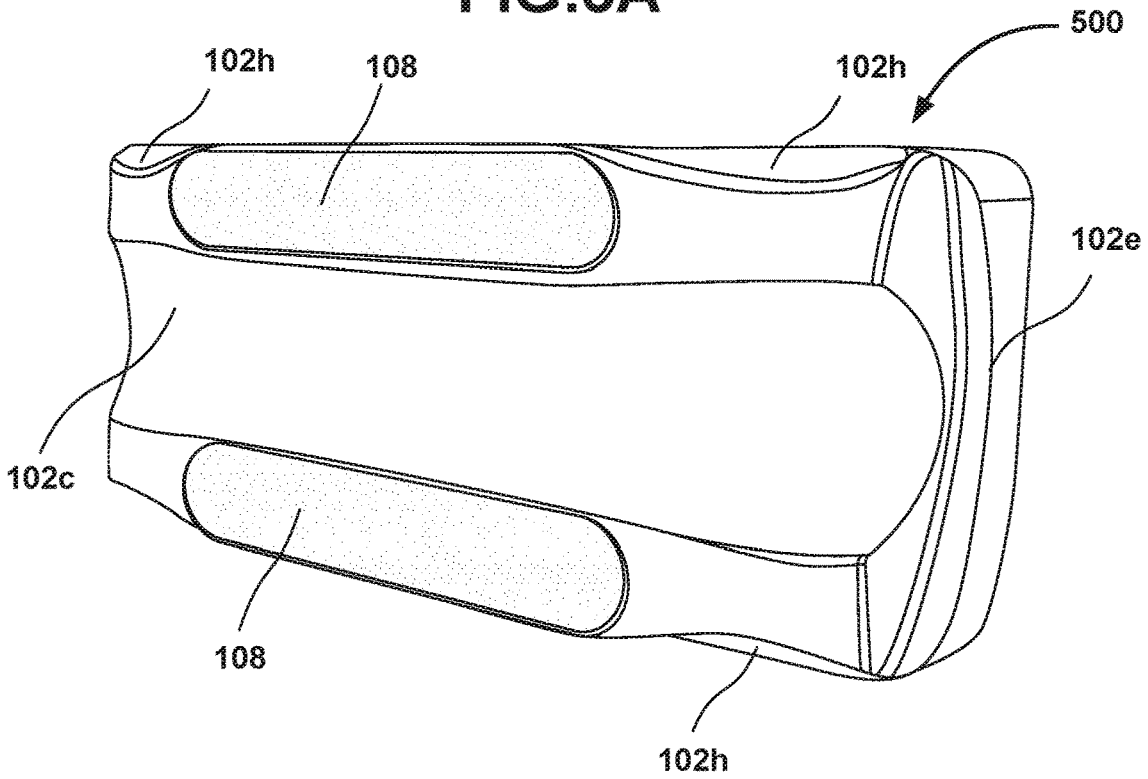

Referring to FIGS. 5A-5B, the tool 500 as shown is similar to the tool 100 of FIG. 1A and essentially includes all the design features similar to FIG. 1A as explained above. However, the tool 500 further includes a secondary surface 108 attached over the first raised support 102*a*, and the second raised support 102*b* to provide a softer surface of the first raised support 102*a*, and the second raised support 102*b*. The softer surface of the raised supports 102*a*, 102*b* helps to improve the comfort to the patient during chiropractic procedures. The secondary surfaces 108 may include but not limited to a gel coat surface, a rubber surface, or a urethane surface, or any combinations thereof.

Embodiment of the present invention described above with respect to FIGS. 1A-1B, 2A-2B, 3-4, and 5A-5B is made as a unitary product or a single piece product. The embodiments of the present invention described above are preferably made of wood, plastic and so on.

Figure 6:
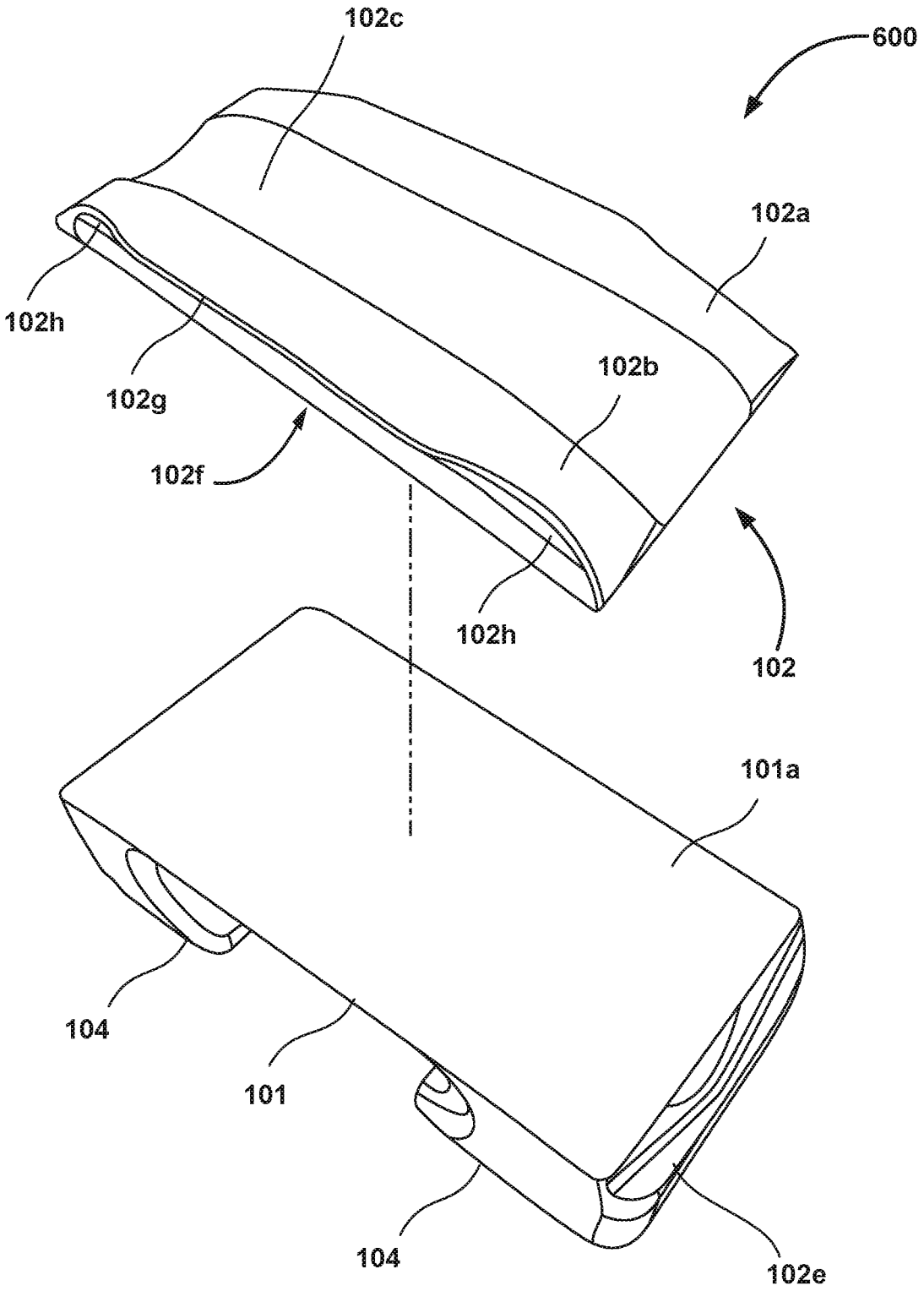
FIG. 6 shows an alternative embodiment of the tool of FIGS. 1A-1B.

Referring to FIG. 6, an alternative embodiment for the tool 600 is shown. Unlike the unitary configuration of the tool shown and described with respect to FIGS. 1A-1B, 2A-2B, 3-4, and 5A-5B, the tool 600 of FIG. 6 shows a two piece configuration. As explained above, the tool 600 includes a flat bottom section 101 preferably made of wood, plastic, other similar material having a top surface 101*a* and a spine adjustment section 102. The flat bottom section 101 has two ends, each of the ends 102*d* transitions to form a protruding edge 102*e* adapted for performing soft tissue mobilization procedure. Each of the protruding edges 102*e* rolls off and protrudes upwardly to form a planar raised surface 104 parallel to the flat bottom 101. The planar raised surfaces 104 together with the flat bottom section 101 serves to function as a "C" shaped open pocket (or handgrip area) facilitating the provider to handgrip the tool 100.

The spine adjustment section 102 according to this embodiment is preferably made of urethane; however use of other soft materials such as rubber, foam, and elastomer is also possible. The spine adjustment section 102 is mountable on the top surface 101*a* of the flat bottom section 101. The spine adjustment section 102 may be attached by adhesive or mechanical means. The spine adjustment section 102 as explained includes a first raised support 102*a*, and a second raised support 102*b* substantially parallel to and aligned with one another at a substantially constant distance apart from one another. The spine adjustment section 102 further includes a spine accommodating area 102*c* concavely formed along and between the length of the raised supports 102*a*, 102*b*. Further, each side 102*f* of the spine adjustment section 102 includes a recessed area 102*g* to allow a provider to hold the tool 100 with the provider's fingertips and to aid in collection and re-dispersal of lotion applied during soft tissue mobilization procedure. Additionally, each of the recessed areas 102*g* located on sides of the spine adjustment section 102 include at least one thumb depression 102*h* to allow the provider to hold the tool 600 with either hand.

Figure 7:
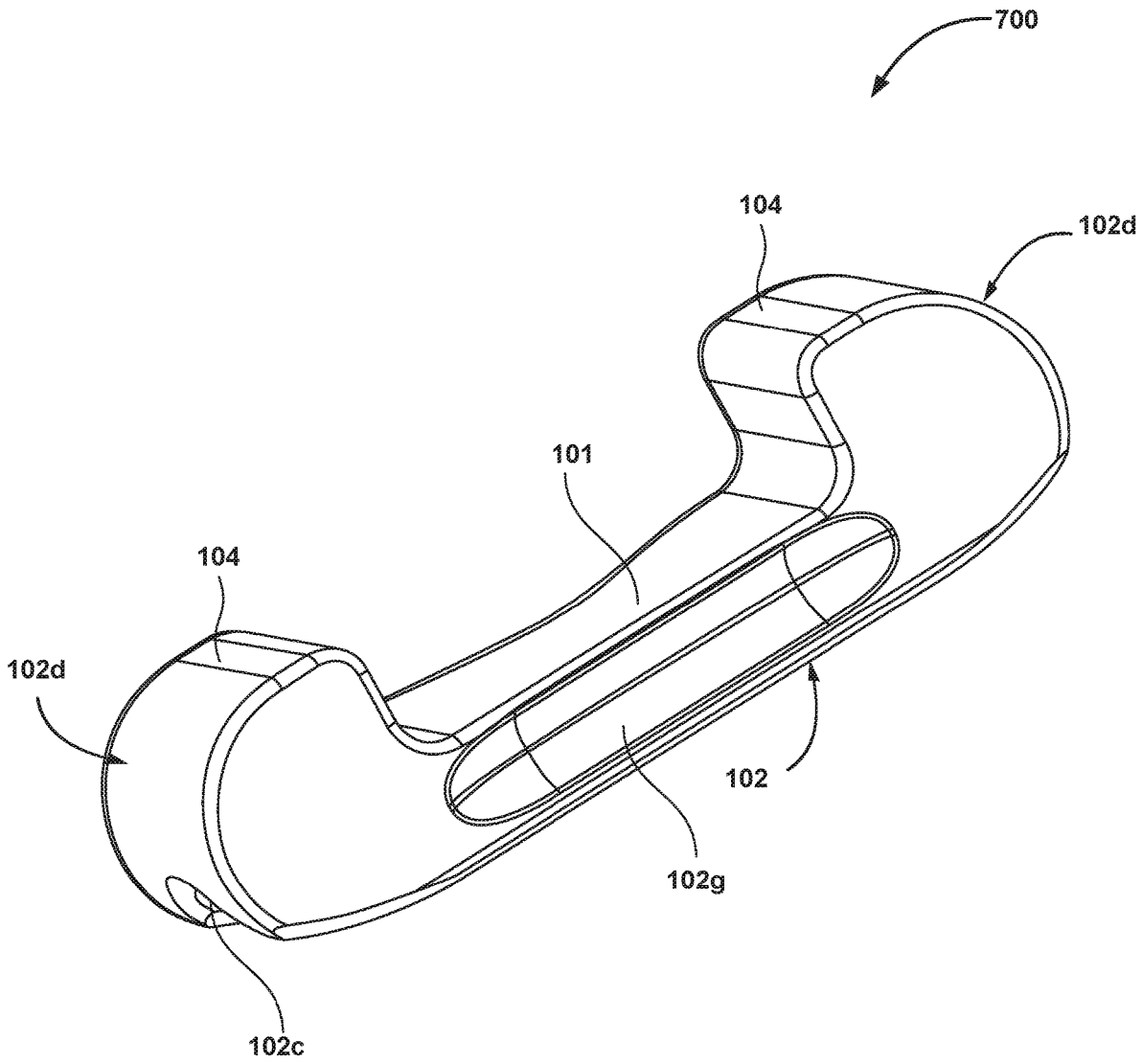
FIGS. 7-9 show additional alternative embodiments of the present invention.
Figure 8:
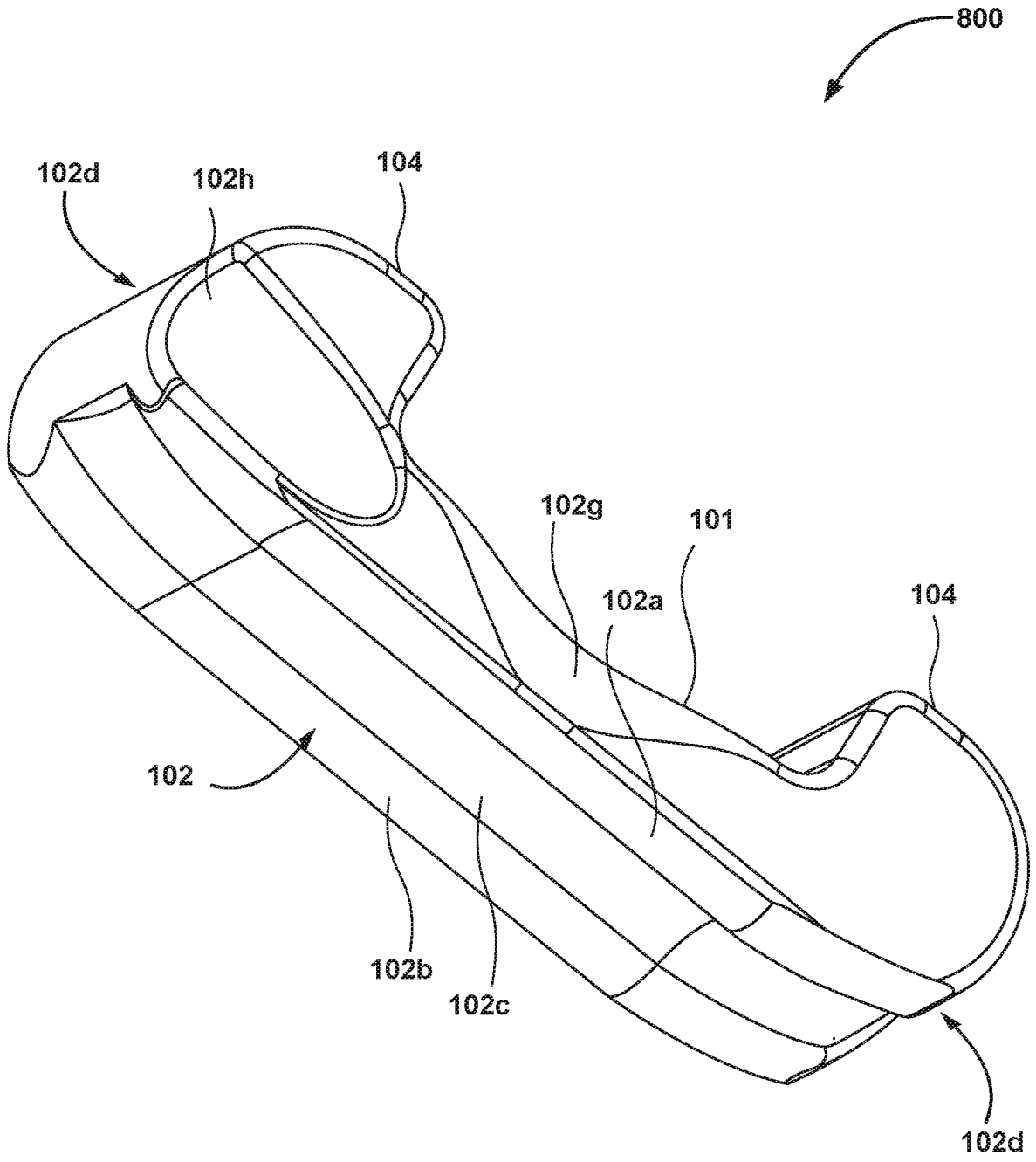
Figure 9:
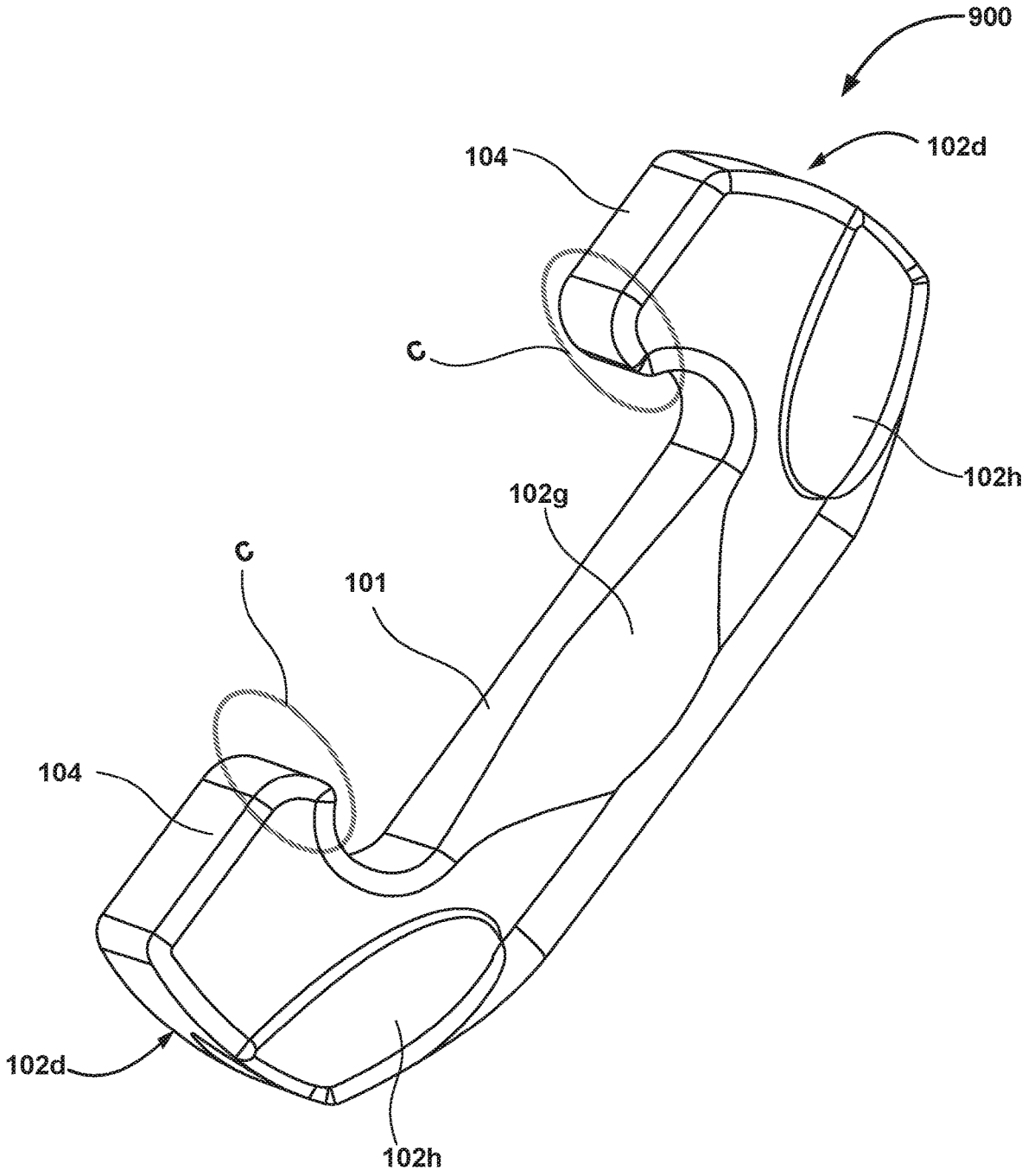

Referring to FIGS. 7-9, some additional alternative embodiments of the present invention are shown. The tool 700 shown in FIG. 7 is essentially similar to the tool shown and described above with respect to FIGS. 1A-1B, 2A-2B, 3-4, and 5A-5B, however the tool 700 does not include any extended edges at the two opposing ends of the spine adjustment section 102, the recessed areas 102*g* on two opposing sides of the tool 700 also differs in shape/configuration when compared to the embodiment shown in FIGS. 1A-1B, 2A-2B, 3-4, and 5A-5B. Particularly, in this embodiment, the recessed areas 102*g* for the provider's fingertips just partially extends along the length of the tool 700. Additionally as shown, the recessed areas 102*g* do not include any thumb depressions. Further, in this embodiment, the tool 700 lacks an open pocket ("C" shaped pocket in particular serving as handgrip). In particular, the two ends of the spine adjustment section 102 protrudes upwardly and rolls out slightly but not sufficiently to form a cut out section "C" as in the embodiment 100 shown in FIG. 2B. The tool 800 in FIG. 8 shows another embodiment, unlike the tool 100 shown in FIGS. 1A-1B, 2A-2B, 3-4, and 5A-5B, the tool 800 includes a different contour for the recessed areas 102*g* for finger grips located on two opposite sides of the tool 800. As seen the tool 800 includes just single thumb depression 102*h* on each side of the tool 800 next to the recessed area 102*g*. Like the embodiment shown in FIG. 7, the tool 800 of FIG. 8 also lacks cut out section "C" that servers as an open pocket or helpful to cradle the tool using the fingers. Similarly, FIG. 9 shows another embodiment of the tool 900. This embodiment of the tool 900 includes similar characteristics as tool 800; however the tool 900 includes two thumb depressions 102 on each side of the tool 900 shown at two ends of the recessed area 102*g*. Further, unlike the tool 800, the tool 900 includes slight cut out sections "C" that functions as finger cradles.

Figure 10:
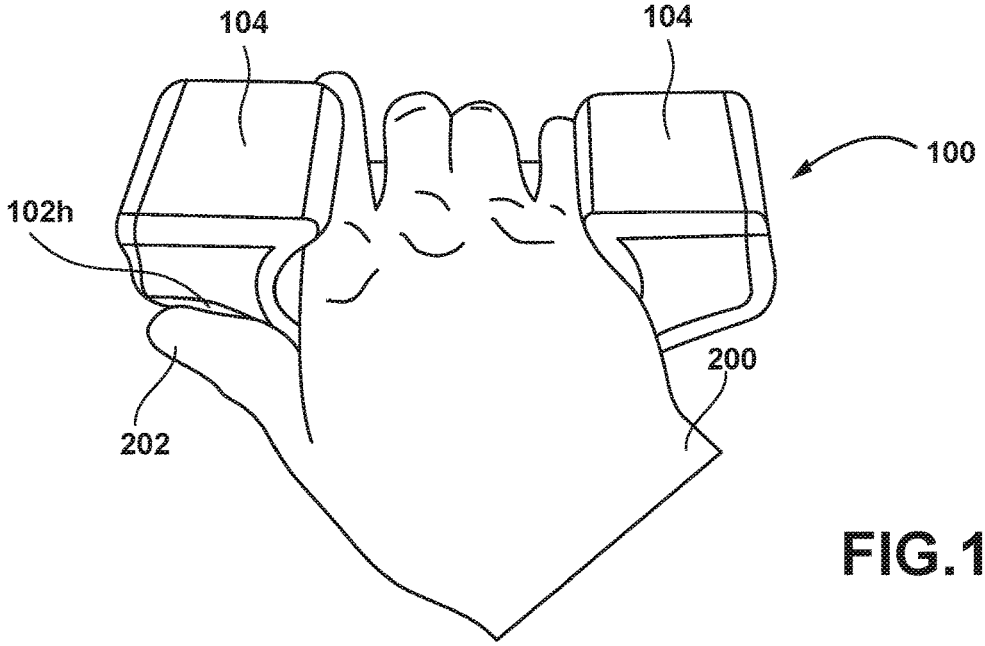
FIGS. 10-12 show some exemplary ways of holding or gripping the tool by a provider when performing spinal manipulations or chiropractic treatments.
Figure 11:
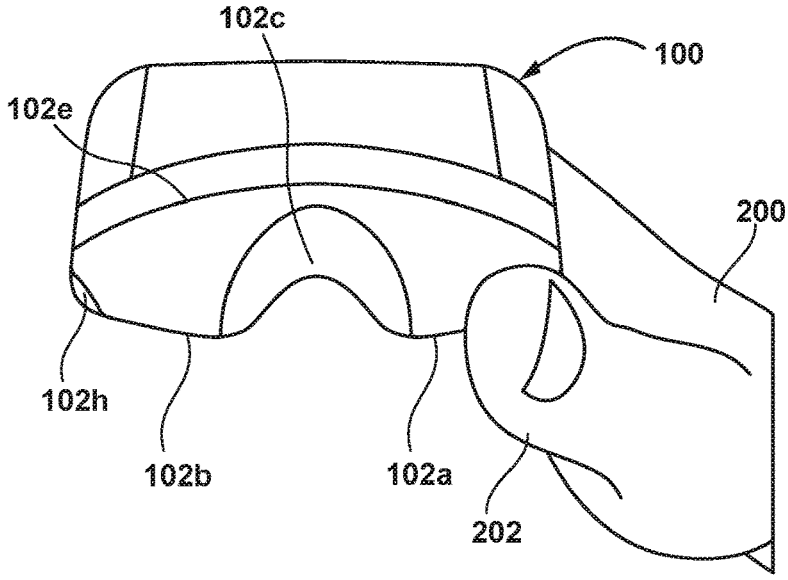
Figure 12:
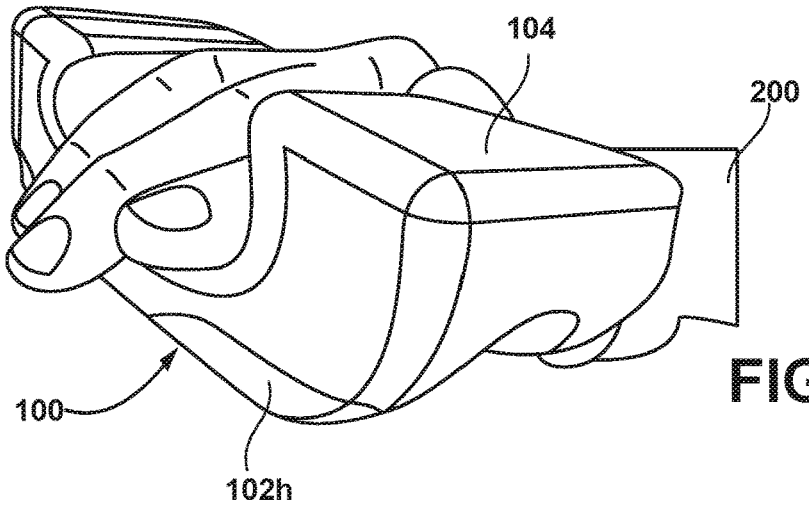

Referring to FIGS. 10-12 shows some exemplary ways of holding or gripping the tool by a provider for performing spinal manipulations or chiropractic treatments. Particularly, FIG. 10 shows a view of a provider's hand 200 gripping the tool 100 through the open pocket (wherein the provider slides his/her four fingers to grip the tool 100) and a thumb 202 is placed in one of the thumb depressions 102*h* to tightly hold the tool 100. FIG. 11 shows a front facing view of a provider's hand 200 gripping the tool 100 in exactly same positions as seen in FIG. 10. FIG. 11 shows another view of a provider's hand 200 gripping the tool 100 in exactly same positions as seen in FIG. 10. This technique of holding or gripping the tool 100 as shown is an exemplary way, however, the provider can hold the device in many other ways as he/she feels comfortable while using the tool 100 for accommodating and manipulating the patient's spine or vertebrae area during chiropractic treatment.

Figure 13:
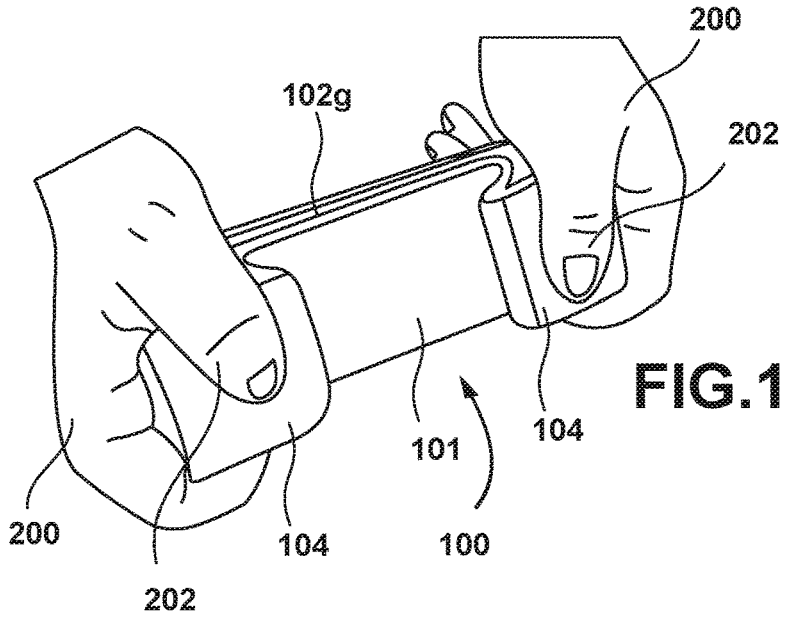
FIGS. 13-15 show some exemplary ways of holding or gripping the tool by the provider when performing soft tissue mobilization or instrument assisted soft tissue mobilization (IASTM) procedures.
Figure 14:
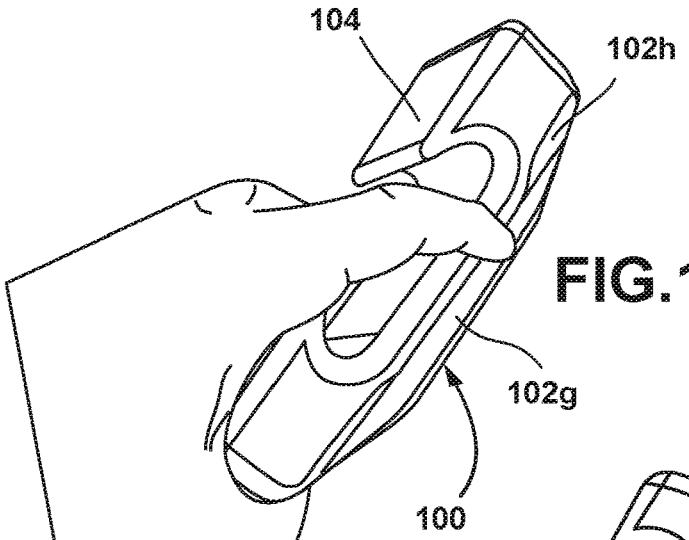
Figure 15:
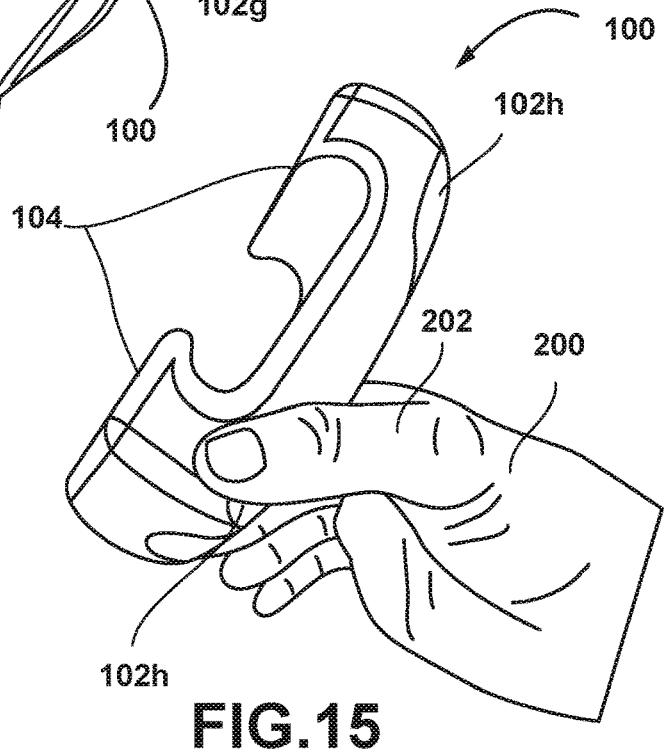

Referring to FIGS. 13-15 shows some exemplary ways of holding or gripping the tool by the provider for performing soft tissue mobilization (STM) or instrument assisted soft tissue mobilization (IASTM) procedures. As an essence, the tool 100 not only assists with chiropractic treatments but can also be used for performing soft tissue mobilization. There are several ways with which the provider can hold the tool using his/her hand or hands to perform soft tissue mobilization of muscles, ligaments and fascia with the goal of breaking adhesions and optimizing muscle function. Particularly, FIG. 13 shows a method of holding the tool 100 where the provider can use his both hands to hold the tool in order to perform soft tissue manipulations. In this technique, the provider may hold/grip the tool 100 from two opposing ends with his thumbs placed on planar raised surfaces 104. FIG. 14 shows a provider's hand holding the tool 100 from one of the ends with an index finger of the hand 200 gripping the recessed area 102*g* (on one of the sides) and the thumb and other fingers holding the tool 100 from one of the ends. FIG. 15 shows another technique for holding the tool, where the provider's hand 200 holds the tool 100 from one of the ends with the thumb 202 placed on the thumb depression 102*h* on one side of the tool 100 and an index finger accessing the lotion in the recessed area 102*g*.

Figure 16:
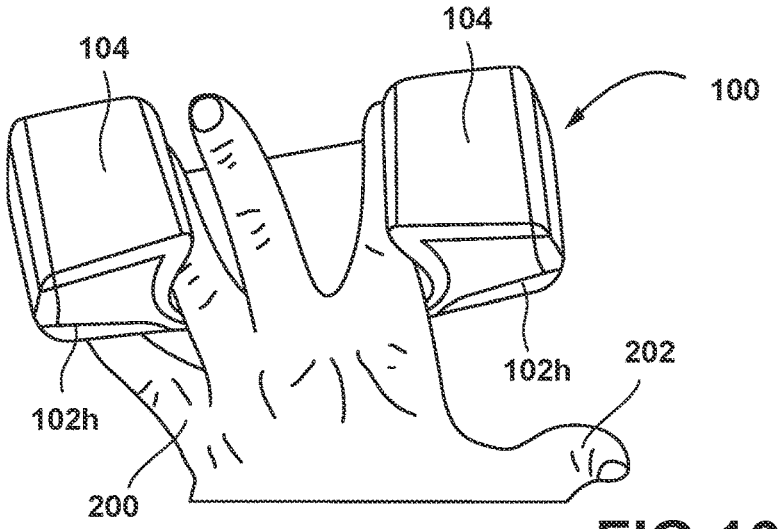
FIG. 16 shows an alternate holding method for the tool by the provider using the fingers to cradle the tool.

FIG. 16 shows an alternate technique for holding the tool wherein the provider is using fingers to cradle the tool. As seen, the provider can insert his/her fingers (three or four fingers excluding the thumb 202) partially within the open pocket area of the tool 100. The provider may insert or slide their fingers sufficiently so that the opposing fingers are locked between the bottom section 101 and the two cut out sections "C", allowing for a cradling of the tool 100. Depending upon the provider's hand sizes, the provider may choose to cradle the tool and use it for spine adjustment or alternatively can also hold the tool as shown and described with respect to the FIGS. 10-12.

Figure 17:
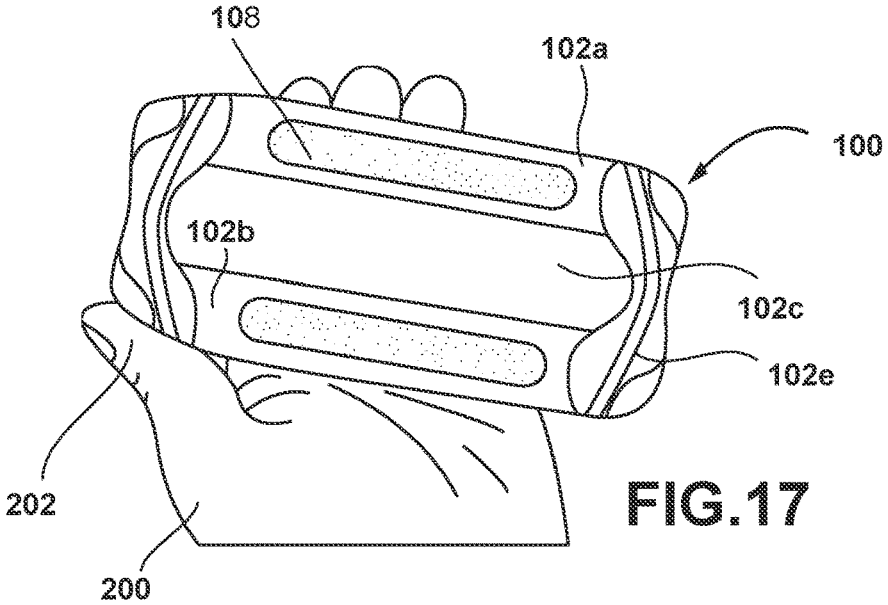
FIG. 17 shows the spinal contour of the tool that's intended to be aligned vertically with the patient's spine during chiropractic treatments.
Figure 18:
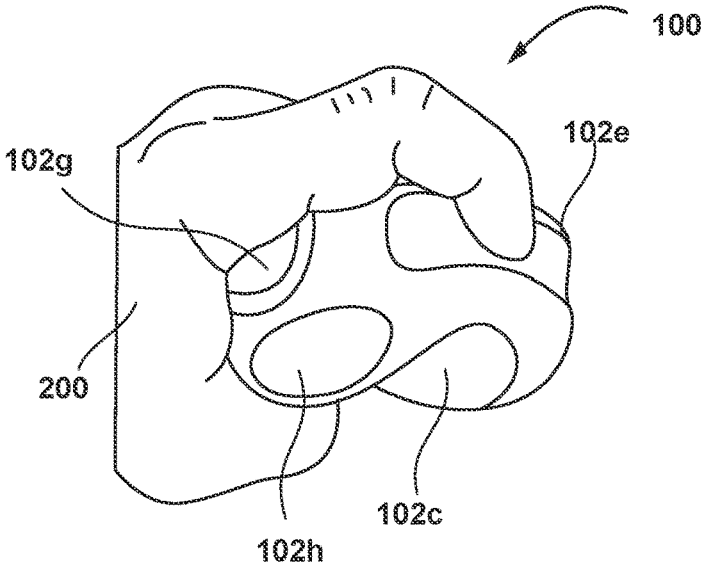
FIG. 18 shows a lotion cavity and curved edge of a protrusion/depression cavity present at an end of the tool.

FIG. 17 shows the spinal contour or spine accommodating area of the tool that is intended to be aligned vertically with the patient's spine during chiropractic treatments. As shown, the tool 100 is held by the provider's hand 200 with the tool's top area facing the patient's spine during an adjustment process. In this method of holding the tool, the provider's thumb 202 is placed on one of the thumb depressions 102*h* and rest of the four fingers are inserted inside the open pocket for gripping the tool. The four fingers may grip the recessed area (not seen) on other side of the tool 100. FIG. 18 shows a lotion cavity or recessed area 102*g* and a curved edge 102*e* of a protrusion/depression cavity present at an end of the tool 100.

Figure 19:
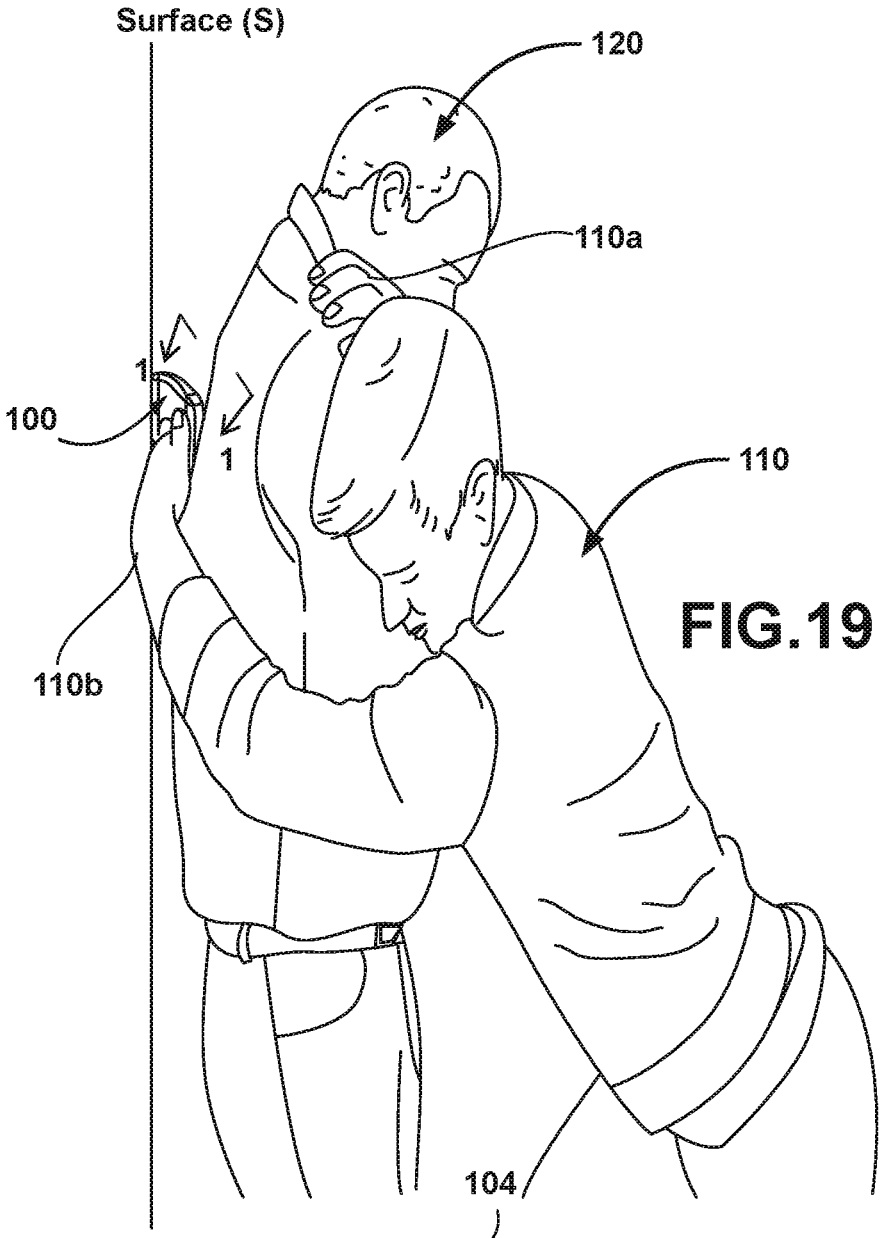
FIG. 19 is schematic illustration of the tool being used by the provider for performing spinal manipulations or chiropractic treatment, in accordance with an embodiment of the invention.
Figure 20:
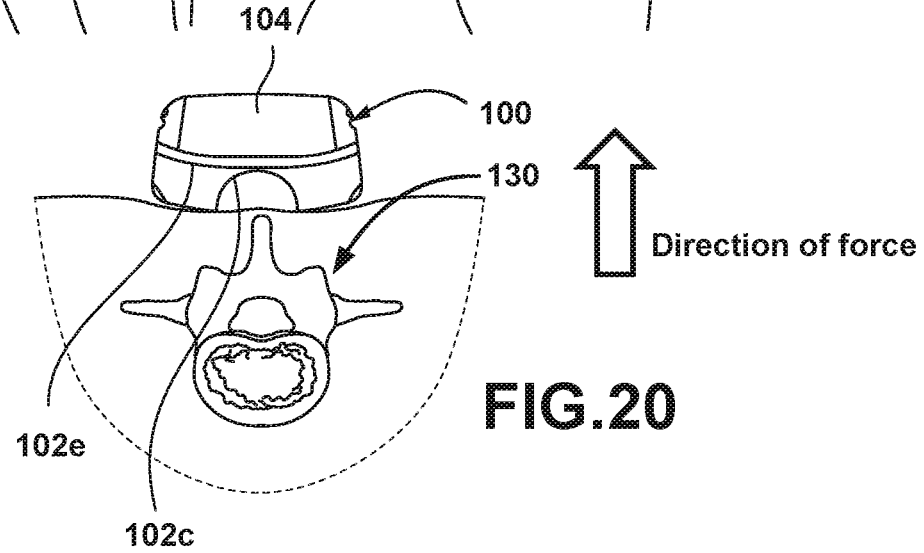
FIG. 20 is a partial section view of FIG. 19 taken along line 1-1 illustrating a relative alignment of the tool with a patient's spine.

Referring to FIGS. 19-20 collectively, where a schematic illustration of the tool in use by a provider (i.e. a physical therapist or chiropractor) is shown. FIG. 19 shows the tool 100 in use for performing spinal manipulations (e.g. the anterior assist) and FIG. 20 shows a partial section view of FIG. 19 taken along line 1-1 illustrating a relative alignment of the tool with a patient's spine.

To utilize the tool 100, the chiropractor 110 first grips the tool 100 as shown in FIGS. 10-12. During this position of holding, the provider's thumb remains free outside rested on the thumb depression of the tool 100 and other four fingers are inserted inside the open pocket and extend outside from other side to hold the tool 100. This holding technique for the tool 100 may differ whereas there can be many other ways to hold the tool such as the one shown in FIG. 16.

When using the tool, the patient 120 may be treated in a seating position on a table (not shown) or in a standing position as described herein. For treating the patient 120 in a standing position, both the patient 120 and chiropractor 110 remain in standing positions as shown in FIG. 19. The patient 120 is made to stand generally facing the chiropractor 110 against a surface (S), such as a wall, with the patient's arms crossed in an 'X' fashion across his/her chest. The chiropractor 110 then holds the patient 120 against him first (using one arm 110*a*), such as chest-to-chest by placing the arm 110*a* around the patient's shoulder and pulling the patient 100 towards him With the tool 100 on the chiropractor's other hand 110*b*, the chiropractor 110 extends his other arm 110*b* around the patient 120 and places the tool 100 near the patient's spine 130. During this process, the chiropractor 110 can use his free thumb and fingertips to locate the position of the patient's spine (or vertebrae region) 130 at a location where chiropractic manipulation is to be performed. Although the left hand 110*b* is depicted in FIG. 19, the right hand could likewise be used, depending on if the chiropractor 110 is right handed or left handed. Once the chiropractor 110 locates the desired vertebrae portion of the patient's spine 130 for manipulation, the tool 100 is placed into engagement with the patient's spine 130, such that the raised supports 102*a*, 102*b* on the tool 100 can be positioned substantially parallel to and on opposite sides of the patient's spine 130 at the manipulation site and the spine accommodating area 102*c* is then aligned over the spine 130 as seen in FIG. 20.

In order to perform the anterior adjustment, the chiropractor 110 continuously holds the patient 120 against him and gradually leans the patient 100 back until back of his hand gripping the tool 100 engages the surface 'S' against which the patient 120 is made to stand. In this situation, the tool 100 is laid between the surface and the patient 120, such as shown in FIG. 19. The anterior adjustment could likewise be performed by the chiropractor 110 based on if the chiropractor 110 is left handed or right handed practitioner. While performing spine manipulation, the patient 120 will be substantially parallel to the wall surface or parallel to the table (if the procedure is done on the table). During this position, the weight of the patient 120 is transferred to the raised supports 102*a*, and 102*b* on the tool 100. The chiropractor 110 can then apply force as needed for performing the spinal manipulation. If needed, the chiropractor 110 can also remove his/her hand out of the tool's open pocket and use both hands to apply force to the patient's chest (depending upon the severity of the case).

Due to the rigid nature of the tool 100 (as the tool is preferably made of wood material), the chiropractic manipulation is accomplished without placing undue stress on the hands of the chiropractor 110. In turn, while using the tool 100, it is the tool 100 that essentially performs the spinal manipulation, leaving the chiropractor's hands unstressed.

Figure 21:
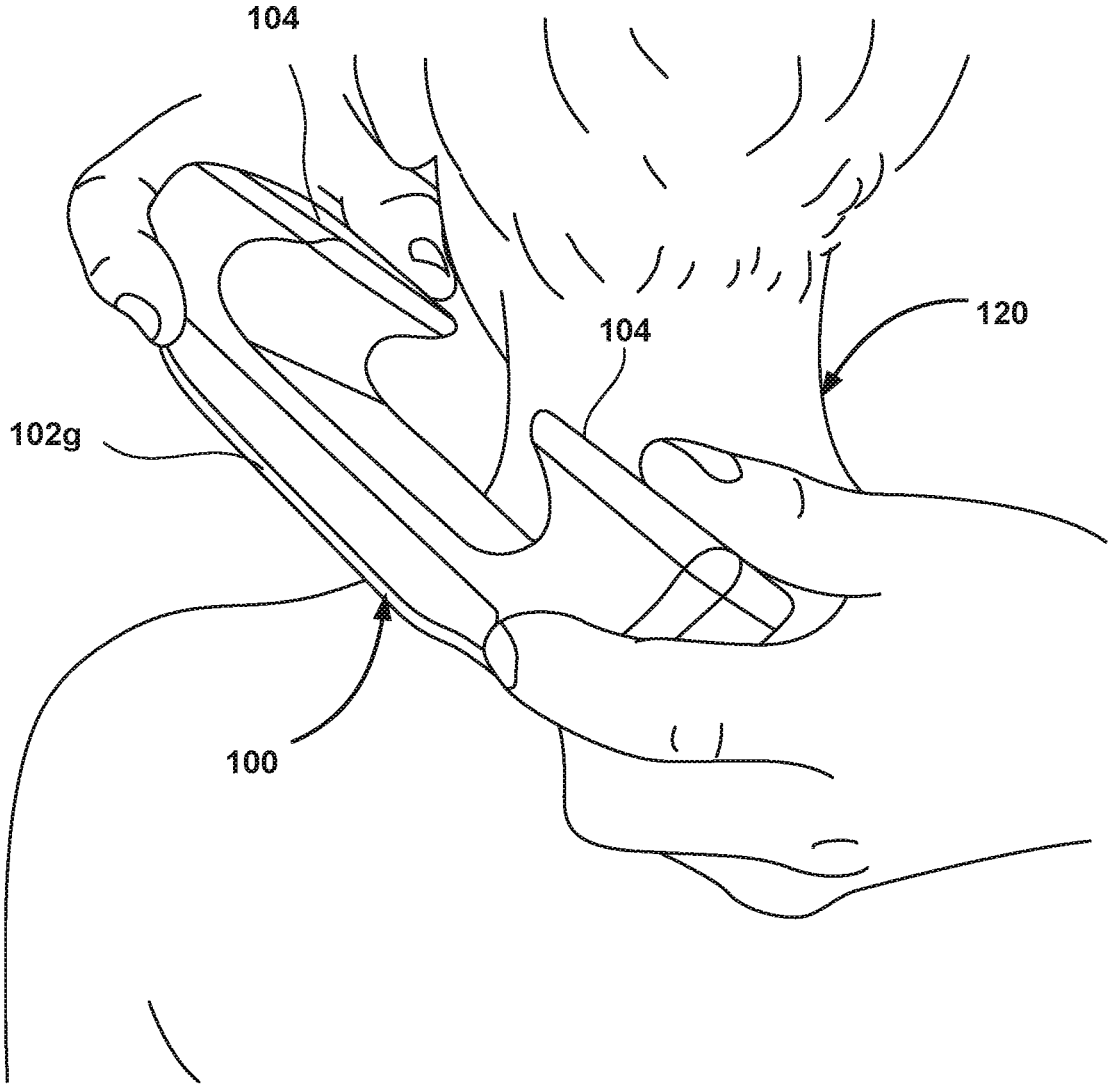
FIG. 21 is a schematic illustration of the tool being used by the provider for performing soft tissue mobilization or instrument assisted soft tissue mobilization (IASTM) procedures.

Referring to FIG. 21, a schematic illustration of the tool being used by the provider (e.g. physical therapist or chiropractor) for performing soft tissue mobilization (STM) or instrument assisted soft tissue mobilization (IASTM) procedures is shown. In the example shown, the soft tissue mobilization (STM) is carried out for neck pain. However it should be understood that STM may be performed in many other regions of the body. In order to perform the STM procedure, the therapist or the chiropractor may hold the tool 100 in way demonstrated in FIGS. 13-15. Preferably in FIG. 21 the tool 100 is shown held by the provider similar to FIG. 13 with the provider gripping the tool 100 from two opposing ends with his thumbs placed on the planar raised surfaces 104 and two index fingers generally being placed over the thumb depressions. In operation, the provider first applies some ointment or lotion (any commercially available tissue massage lotions for example Biotone®) in the areas or portion of the neck that needs treated. Then, the provider tilts the tool 100 sideways ensuring the recessed area 102*g* on one side of the tool 100 can be dragged/moved over the area of the neck being treated and applied with the lotion. The motion can be applied multiple times within some predefined time frame depending upon the severity of the pain. While moving the tool (particularly, the recessed area 102*g*) against the affected area of the neck with lotion, the lotion gets collected in the recessed area 102*g* whereas the collected lotion can then be re-dispersed over the area being treated, thereby the tool 100 can help in reducing waste of the treatment lotion.

Embodiments of the invention have been described in detail for purposes of illustration, various modifications and enhancements may be made without departing from the spirit and scope of the invention.

What is claimed is:

1. A chiropractic adjustment and soft tissue mobilization tool (100), comprising:

a flat bottom section (101);

a spine adjustment section (102) having a first raised support (102*a*), and a second raised support (102*b*) substantially parallel to and aligned with one another at a substantially constant distance apart from one another, and a spine accommodating area (102*c*) concavely formed along and between the length of the first raised support (102*a*), and the second raised support (102*b*), the spine accommodating area (102*c*) is adapted for supporting an intended vertebrae portion of a patient's spine during chiropractic adjustment;

wherein the spine adjustment section includes first and second opposite ends (102*d*), wherein the first end (102*d*) of the spine adjustment section (102) further transitions to form a first protruding edge (102*e*) adapted for performing soft tissue mobilization procedure, wherein the first protruding edge (102*e*) of the spine adjustment section (102) further protrudes upwardly and rolls off to form a first planar raised surface (104) parallel to the flat bottom (101), wherein the second end (102*d*) of the spine adjustment section (102) further transitions to form a second protruding edge (102*e*) adapted for performing soft tissue mobilization procedure, wherein the second protruding edge (102*e*) of the spine adjustment section (102) further protrudes upwardly and rolls inwardly to form a second planar raised surface (104) parallel to the flat bottom (101), wherein the first planar raised surface (104) has a first inner edge and the second planar raised surface (104) has a second inner edge, wherein the first and second inner edges face in opposite directions and are separated from each other by a gap; and Wherein, each side (102*f*) of the spine adjustment section (102) features a recessed area (102*g*) formed thereof to allow a provider to hold the tool (100) with the provider's fingertips, and to aid in collection and re-dispersal of lotion applied during soft tissue mobilization procedure.

2. The tool (100) of claim 1, wherein the first and second planar raised surfaces (104) together with the flat bottom section (101) serves to function as an open pocket facilitating the provider to slide the fingers therein for holding the tool (100).

3. The tool (100) of claim 2, wherein the open pocket is substantially "C" shaped and serves as a handgrip for the tool (100).

4. The tool (100) of claim 1, wherein at least one of the first and second planar raised surfaces (104) selectively embodies at least one magnet (106) to allow the provider to attach the tool (100) to a surface for storage.

5. The tool (100) of claim 1, wherein each of the recessed areas (102*g*) further includes at least one thumb depression (102*h*) to allow the provider to hold the tool with either hand.

6. The tool (100) of claim 5, wherein the at least one thumb depression (102*h*) is located either at one end or both the ends of each of the recessed areas (102*g*).

7. The tool (100) of claim 1 further comprising a secondary surface (108) attached over the first raised support (102*a*), and the second raised support (102*b*) to soften the surface of the first raised support (102*a*), and the second raised support (102*b*).

8. The tool (100) of claim 7, wherein the secondary surface (108) comprises a gel coat surface or a rubber surface or a urethane surface.

9. The tool (100) of claim 1, wherein the tool (100) is a unitary tool made from a material consisting of wood, plastic or composite material.

10. A chiropractic adjustment and soft tissue mobilization tool (100), comprising:

a flat bottom section (101) having a top surface (101*a*)

a spine adjustment section (102) having a first raised support (102 *a*), and a second raised support (102*b*) substantially parallel to and aligned with one another at a substantially constant distance apart from one another, and a spine accommodating area (102*c*) concavely formed along and between the length of the first raised support (102*a*), and the second raised support (102*b*), the spine accommodating area (102*c*) is adapted for supporting an intended vertebrae portion (130) of a patient's spine during chiropractic adjustment;

wherein the spine adjustment section includes first and second opposite ends (102*d*), wherein the first end (102*d*) of the spine adjustment section (102) protrudes upwardly and rolls off to form a first planar raised surface (104) relative to the flat bottom (101), wherein the second end (102*d*) of the spine adjustment section (102) protrudes upwardly and rolls inwardly to form a second planar raised surface (104) relative to the flat bottom (101), wherein the first planar raised surface (104) has a first inner edge and the second planar raised surface (104) has a second inner edge, wherein the first and second inner edges face in opposite directions and are separated from each other by a gap; and Wherein, each side (102*f*) of the spine adjustment section (102) features a recessed area (102*g*) formed thereof to allow a provider (110) to hold the tool (100) with the provider's fingertips, and to aid in collection and re-dispersal of lotion applied during soft tissue mobilization procedure.

11. The tool (100) of claim 10, wherein each of the recessed areas (102*g*) further includes at least one thumb depression (102*h*) to allow the provider (110) to hold the tool (100).

12. The tool (100) of claim 11, wherein the at least one thumb depression (102*h*) is located either at one end or both the ends of each of the recessed areas (102*g*).

13. A chiropractic adjustment and soft tissue mobilization tool (100), comprising:

a flat bottom section (101) having a top surface (101*a*) and two ends, each of the ends (102*d*) transitions to form a protruding edge (102*e*) adapted for performing soft tissue mobilization procedure, wherein, each of the protruding edge (102*e*) further rolls off and protrudes upwardly to form a planar raised surface (104) parallel to the flat bottom (101);

a flat bottom section (101) having a top surface (101*a*) and first and second opposite ends (102*d*), wherein the first end (102*d*)) transitions to form a first protruding edge (102*e*) adapted for performing soft tissue mobilization procedure, wherein the first protruding edge (102*e*) further protrudes upwardly and rolls off to form a first planar raised surface (104) parallel to the flat bottom (101), wherein the second end (102*d*) transitions to form a second protruding edge (102*e*) adapted for performing soft tissue mobilization procedure, wherein the second protruding edge (102*e*) further protrudes upwardly and rolls inwardly to form a second planar raised surface (104) parallel to the flat bottom (101), wherein the first planar raised surface (104) has a first inner edge and the second planar raised surface (104) has a second inner edge, wherein the first and second inner edges face in opposite directions and are separated from each other by a gap;

a spine adjustment section (102) is mountable on the top surface (101*a*) of the flat bottom section (101), the spine adjustment section (102) having a first raised support (102*a*), and a second raised support (102*b*) substantially parallel to and aligned with one another at a substantially constant distance apart from one another, and a spine accommodating area (102 *c*) concavely formed along and between the length of the first raised support (102*a*), and the second raised support (102*b*), the spine accommodating area (102*c*) is adapted for supporting an intended vertebrae portion of a patient's spine during chiropractic adjustment; and Wherein, each side (102*f*) of the spine adjustment section (102) features a recessed area (102*g*) formed thereof to allow a provider to hold the tool (100) with the provider's fingertips and to aid in collection and redispersal of lotion applied during soft tissue mobilization procedure.

14. The tool (100) of claim 13, wherein the flat bottom section (101) is made from a material selected from a group consisting of a wood, plastic or composite material.

15. The tool (100) of claim 13, wherein the spine adjustment section (102) is made from a material selected from a group consisting of a urethane, rubber, foam, wood, or elastomer.

16. The tool (100) of claim 13, wherein the first and second planar raised surfaces (104) together with the flat bottom section (101) serves to function as a "C" shaped open pocket facilitating the provider to handgrip the tool (100).

17. The tool (100) of claim 13, wherein each of the recessed areas (102*g*) further includes at least one thumb depression (102*h*) to allow the provider to hold the tool with either hand.

* * * * *